US008136187B2

(12) United States Patent
Mossbeck et al.

(10) Patent No.: US 8,136,187 B2
(45) Date of Patent: Mar. 20, 2012

(54) SLOW ACTING POCKETED SPRING CORE AND METHOD OF MANUFACTURING SAME

(75) Inventors: Niels S. Mossbeck, Carthage, MO (US); Terry W. Moser, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 944 days.

(21) Appl. No.: 12/142,310

(22) Filed: Jun. 19, 2008

(65) Prior Publication Data

US 2008/0246197 A1 Oct. 9, 2008

Related U.S. Application Data

(63) Continuation-in-part of application No. 11/672,088, filed on Feb. 7, 2007, now Pat. No. 7,636,972.

(51) Int. Cl.
*A47C 25/00* (2006.01)

(52) U.S. Cl. ..... 5/720; 5/716

(58) Field of Classification Search ..... 5/716, 720, 5/655.8, 654.1

See application file for complete search history.

(56) References Cited

U.S. PATENT DOCUMENTS

| | | | | |
|---|---|---|---|---|
| 1,053,675 | A | 2/1913 | Suekoff, Jr. | |
| 1,455,847 | A | 5/1923 | Meutsch | |
| 2,615,180 | A | 10/1952 | Wolter | |
| 2,878,012 | A | 3/1959 | Crites | |
| 3,855,653 | A | 12/1974 | Stalter, Sr. | |
| 4,439,977 | A | 4/1984 | Stumpf | |
| 4,451,946 | A | 6/1984 | Stumpf | |
| 4,541,136 | A | 9/1985 | Graebe | |
| 4,854,023 | A | 8/1989 | Stumpf | |
| 4,895,352 | A | 1/1990 | Stumpf | |
| 4,986,518 | A | 1/1991 | Stumpf | |
| 5,424,115 | A | 6/1995 | Stokes | |
| 5,467,489 | A | 11/1995 | Cchen | |
| 5,509,887 | A | 4/1996 | Smith | |
| 5,868,383 | A * | 2/1999 | Codos | 267/80 |
| 6,101,697 | A | 8/2000 | Stumpf et al. | |
| 6,131,892 | A | 10/2000 | Stumpf | |
| 6,159,319 | A | 12/2000 | Mossbeck | |
| 6,173,464 | B1 | 1/2001 | McCune et al. | |
| 6,295,673 | B1 | 10/2001 | Mossbeck | |
| 6,487,738 | B1 | 12/2002 | Graebe | |
| 6,490,744 | B1 | 12/2002 | Schulz, Jr. | |
| 6,591,436 | B2 | 7/2003 | de Santis et al. | |
| 6,598,251 | B2 | 7/2003 | Habboub et al. | |
| 6,668,406 | B2 | 12/2003 | Spinks et al. | |
| 6,687,933 | B2 | 2/2004 | Habboub et al. | |
| 6,966,091 | B2 * | 11/2005 | Barber | 5/716 |
| 6,986,182 | B2 | 1/2006 | Mossbeck | |
| 2002/0162173 | A1 | 11/2002 | Formenti | |
| 2010/0212090 | A1 | 8/2010 | Stjerna | |

FOREIGN PATENT DOCUMENTS

| | | |
|---|---|---|
| DE | 7926956 | 1/1980 |
| EP | 0052389 | 5/1982 |
| EP | 0553772 | 8/1993 |
| EP | 0624332 | 5/1994 |
| EP | 1707081 | 4/2006 |

(Continued)

*Primary Examiner* — Fredrick Conley

(74) *Attorney, Agent, or Firm* — Wood, Herron & Evans, LLP

(57) ABSTRACT

Spring cushions (10) having slow-acting pocketed spring cores (12) characterized by the individual springs of the cores (12) being pocketed within semi-impermeable fabric material and a method of making such pocketed spring cores (12).

22 Claims, 4 Drawing Sheets

FOREIGN PATENT DOCUMENTS

| | | |
|---|---|---|
| JP | 2001340175 | 12/2001 |
| WO | 2007102772 | 9/2007 |

* cited by examiner

SLOW ACTING POCKETED SPRING CORE AND METHOD OF MANUFACTURING SAME

CROSS REFERENCE TO RELATED APPLICATIONS

This application is a continuation-in-part of U.S. patent application Ser. No. 11/672,088 filed Feb. 7, 2007 entitled "Slow Acting Pocketed Spring Core", which is fully incorporated herein.

TECHNICAL FIELD OF THE INVENTION

This invention relates to resilient cushions and, more particularly, to pocketed spring cores used in seating cushions or bedding mattresses and the method of manufacturing such pocketed spring cores.

BACKGROUND OF THE INVENTION

Spring cores are commonly used in seating or bedding products. Such spring cores commonly are made from assemblies or matrixes of multiple springs joined together directly as by helical lacing wires, or indirectly as by fabric within which each individual spring is contained. Such spring cores, whether the springs of the cores are connected directly or indirectly, are generally covered on the top and often on the bottom by pads of resilient foam, as for example, a pad the top and often on the bottom by pads of resilient foam, as for example, a pad of urethane or latex/urethane mix of foamed material. Within the last several years, more expensive cushions or mattresses have had the spring cores covered by a visco-elastic foam pad which is slow acting. That is, the visco-elastic foam pad is slow to compress under load and slow to recover to its original height when the load is removed from the visco-elastic foam pad. These visco-elastic pads impart a so-called luxury feel to the mattress or cushion, but these pads also, because of their closed cell structure, retain heat and are slow to dissipate body heat when a person sits or lies atop such a visco-elastic foam pad-containing cushion or mattress.

It is therefore been an objective of this invention to provide a seating or bedding cushion or mattress which has the same luxury feel as a visco-elastic pad-containing cushion, but without the heat retention characteristics of such a visco-elastic pad-containing cushion or mattress.

Still another objective of this invention has been to provide a cushion or mattress having the same or a very similar slow-to-compress and slow-to-recover to its original height luxury feel cushion or mattress as one containing visco-elastic foam pads, but which is substantially less expensive to manufacture.

SUMMARY OF THE INVENTION

The invention of this application which accomplishes these objectives comprises a seating or bedding spring core made from an assembly of pocketed springs, each spring of which is contained within a fabric pocket. The fabric pocketing material within which the springs are contained is semi-impermeable to air flow through the fabric material. As used herein, the term "semi-impermeable" means that the fabric material, while permitting some air flow through the material, does so at a rate which retards or slows the rate at which a spring maintained in a pocket of the fabric may compress under load or return to its original height when a load is removed from the pocketed spring. In other words, air may pass through such a semi-impermeable material, but at a very reduced rate compared to the rate at which air usually flows freely through a fabric material.

In one embodiment of the invention, the semi-impermeable fabric material within which the springs of the pocketed spring assembly are contained is a spun-bonded polypropylene fabric available from Hanes Industries of Conover, N.C. under the name Elite 200. This Elite 200 fabric is coated with a layer of polyurethane. Such a non-woven fabric has a few pinholes, some of which may be covered by the coating. However, the fabric is not air tight due to the presence of some holes. The air permeability or porosity of a material is commonly measured using the American Society of Testing Materials ("ASTM") method ASTM-D737, which is fully incorporated herein. However, when tested using this method the material for this application may be not be quantified because the porosity is so low. Of course, the fabric material within which the pocketed springs are contained may be any semi-impermeable fabric material which, at ambient air pressure, retards or slows air pressure through the material. The fabric may be a woven or unwoven material which may be coated in a secondary process with a polymer to achieve the requisite semi-impermeable air flow characteristics described hereinabove.

In another embodiment of the invention, the semi-impermeable fabric pockets within which the springs of the pocketed spring assembly are contained comprise multiple layers of material. In one embodiment, the pocket comprises three layers: a middle layer of a polyolefin plastic material and outer layers of non-woven polypropylene fabric material. The outer layer of non-woven polypropylene fabric material provides strength and a satisfactory gluing or ultrasonic welding surface. The middle layer controls the air flow. The inner layer of non-woven polypropylene fabric material provides a quiet material which prevents "noise" created by the coil spring in the pocket rubbing against the fabric material of the pocket. One or more holes extend through all three layers of the pocket and enable air to slowly enter or exit the interior of the pocket, depending upon whether the pocket is under a load.

In accordance with the practice of this invention, the pocketed spring core assembly having the slow acting compression and slow-to-recover original height characteristics of this invention may be inexpensively manufactured upon the same pocketed spring machinery, with very little modification, which is now utilized to manufacture conventional pocketed spring assemblies. Expressed another way, the advantageous spring cushion assembly of this invention may be manufactured upon existing pocketed spring equipment without any substantial modification of that equipment or machinery. As a result, this advantageous pocketed spring core assembly with its unique compression and recovery characteristics is, in accordance with the practice of this invention, manufactured according to the current manufacturing processes of existing pocketed spring assemblies with only the fabric material utilized in the practice of the process being changed from an air permeable fabric, as is now conventional, to an air semi-impermeable fabric material. This conventional process, absent the unique fabric utilized in the practice of this invention, is completely illustrated and described in prior art patents as, for example, Stumpf U.S. Pat. No. 4,439,977; Stumpf et al U.S. Pat. No. 6,101,697; and, Santis et al U.S. Pat. No. 6,591,436. These patents all describe apparatus for manufacturing continuous strings of coil springs contained within fabric pockets. The fabric pockets of these springs are generally unsealed from one pocket to the next. But in accordance with the practice of this invention, the seals are all continuous and preferably by sinusoidal-shaped seals, so as to created individual pockets. After being formed into continuous strings of pocketed springs, the springs are in accordance with the practice of this invention are cut into strings of predetermined discrete lengths which are then assembled by gluing together the strings either directly or indirectly via a sheet of fabric on the top or bottom of the side-by-side juxtapositioned strings of coils. Mossbeck U.S. Pat. No. 6,159,319 discloses such an assembly process.

One patent which discloses a point bonded non-woven fabric and method of making that fabric suitable for use in the practice of this invention is Stokes U.S. Pat. No. 5,424,115. The disclosures and contents of the above-identified patents are hereby incorporated by reference in their entirety for purposes of completing the disclosure of this application.

The primary advantage of this invention is that it gives rise to a relatively inexpensive seating or bedding cushion which has the luxurious slow-acting compression and height recovery characteristics of heretofore expensive visco-elastic foam containing cushions. And in accordance with the practice of this invention, the cushion having these characteristics may be relatively inexpensively manufactured on currently existing equipment with very little modification of that production equipment.

These and other objects and advantages of this invention will be more readily apparent from the following drawings, in which:

DETAILED DESCRIPTION OF THE DRAWINGS

Figure 1:
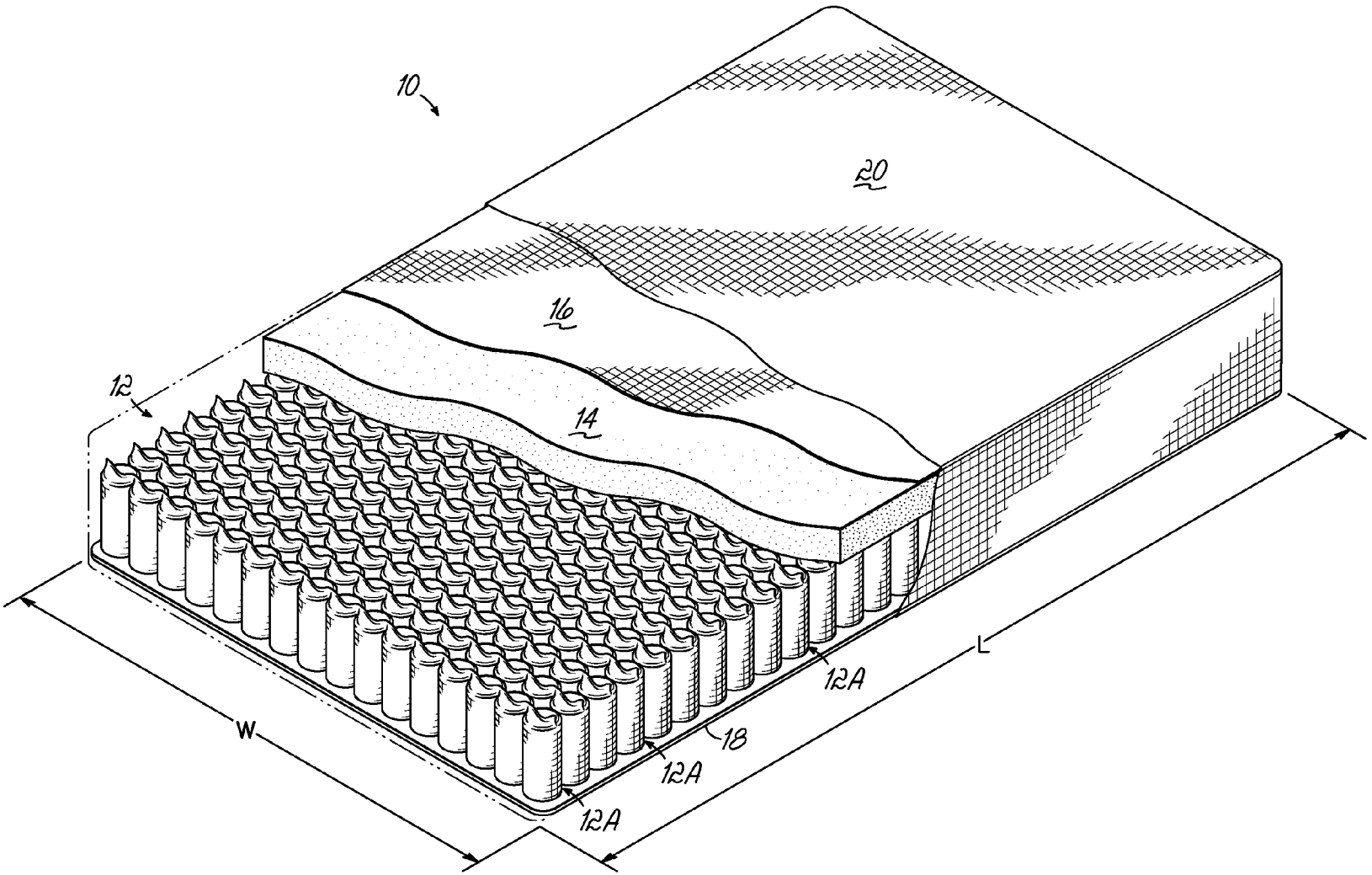
FIG. 1 is a perspective view, partially broken away, of a cushion incorporating the pocketed spring core invention of this invention.

With reference to FIG. 1, there is illustrated a cushion in the form of a single-sided mattress 10 incorporating this invention. This cushion or mattress 10 comprises a pocketed spring core 12 over the top of which there is a conventional foam pad 14 covered by a fiber pad 16. This complete assembly is mounted upon a base 18 and is completely enclosed within an upholstered covering material 20.

While one embodiment of the invention described herein is illustrated and described as being embodied in a single-sided mattress, it is equally applicable to double-sided mattresses or seating cushions. In the event that it is utilized in connection with a double-sided mattress, then the bottom side of the spring core usually has a foam pad applied over the bottom side of the spring core and that pad is in turn covered by a fiber pad of cushioning material. According to the practice of this invention, though, either the foam pad or the fiber pad or both may be omitted while still practicing the invention of this application wherein the novel features reside in the pocketed spring core 12.

The pocketed spring core 12 may be made upon any conventional pocketing spring manufacturing machine and by any conventional pocketing spring process so long as the machine and process utilized the special fabric material to be described hereinbelow for pocketing the springs of the assembly. One machine and process suitable for creating the pocketing spring assembly 12 is described in Santis et al U.S. Pat. No. 6,591,436 assigned to the assignee of this application. With very little modification as described hereinbelow, that machine and process may be used in the practice of this invention. While that machine creates so-called "side seam pocketed coil springs", this invention is equally applicable to spring cores wherein the strings of springs have the longitudinal seam on the top of the string of pocketed springs rather than on the sides of the springs. Such top seamed pocketed spring cores and the methods by which they are manufactured are described, for example, in Stumpf U.S. Pat. No. 4,439,977 and Stumpf et al U.S. Pat. No. 6,101,697. With very little modification, as explained more fully hereinbelow, the machines and processes of these top seam pocketed spring assemblies may also be utilized in the practice of this invention.

Still with reference to FIG. 1, it will be seen that the pocketed spring core 12 is manufactured from multiple strings 12A of pocketed springs, each string of which extends across the full width of the product 10. These strings are connected in side-by-side relationship as, for example, by gluing the sides of the strings together in an assembly machine, such as the assembly machine disclosed in Mossbeck U.S. Pat. No. 6,159,319, so as to create an assembly or matrix of springs having multiple rows and columns of pocketed springs bound together as by gluing, welding or any other conventional assembly process commonly used to create pocketed spring cores.

Figure 3:
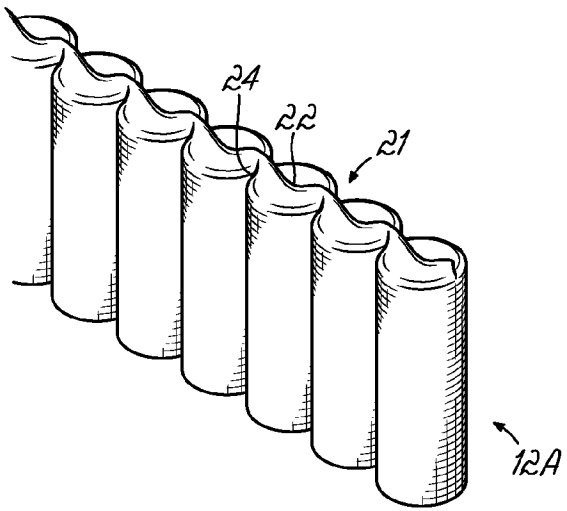
FIG. 3 is an enlarged perspective view of a portion of a string of pocketed coil springs used in the pocketed spring core of FIG. 1.

With reference now to FIG. 3, there is illustrated a portion of one string 12A of the pocketed spring core 12. This string differs from the strings of coil springs illustrated and described in U.S. Pat. No. 6,591,436 only in that the overlapped seam 21 of fabric is secured together by a sinusoidal wave-shaped welded seam 22 and the vertical welded seams 24 between adjacent coil springs in a string of pocketed coil springs is a continuous sinusoidal welded seam 24 rather than a discontinuous seam as in U.S. Pat. No. 6,591,436. These seams are accomplished by the welding horn of the machine having a sinusoidal-shaped welding element rather than multiple spaced protrusions on the welding head. As a result of these welded seam seals defining the spring-containing pockets of the string of coil springs, each spring of the string is sealingly enclosed within its individual pocket. If the fabric material defining these pockets and enclosing the springs therein were completely air-impermeable, then these pockets could only be compressed by compressing the air contained within the pockets. In actuality, and as explained more fully hereinafter, this fabric material is semi-impermeable so that the rate at which the springs compress when a load is placed upon the top of a pocketed spring core assembly containing the springs is only slowed or retarded by the air entrapped within the individual pockets as the pocketed spring assembly is compressed and similarly, the rate of return of the compressed coil spring assembly to its original height after compression is retarded or slowed by the rate at which air may pass through the semi-impermeable fabric material into the interior of the individual pockets of the coil spring assembly.

Figure 2:
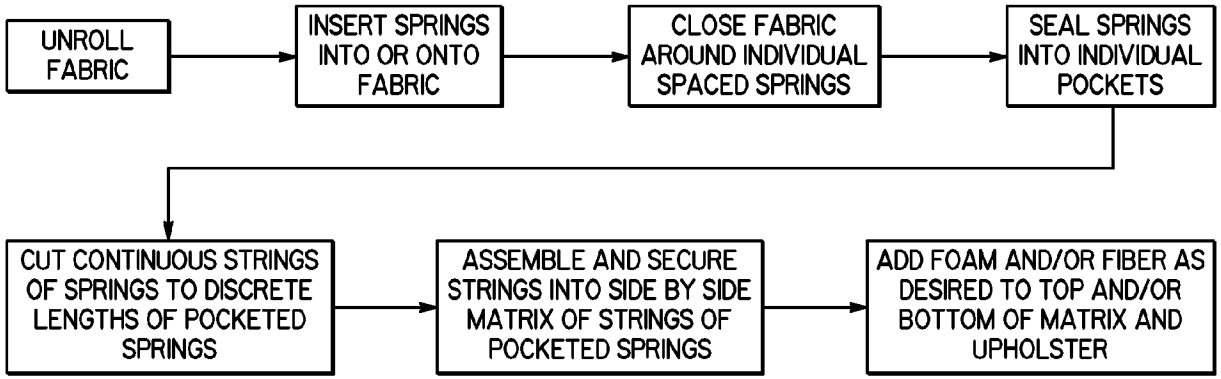
FIG. 2 is a schematic drawing of the process by which cushion spring cores made in accordance with the practice of this invention are manufactured.

With reference now to FIG. 2, there is illustrated the process by which the coil spring assembly of FIG. 1 is manufactured utilizing the machines and processes of the above-identified patents. This process comprises starting with a roll of fabric material which is unrolled and has springs either inserted between a fold of the fabric or placed onto the fabric. Thereafter, the fabric is enclosed around the individual spaced springs located either between the folded springs or on the top of the fabric material. The fabric is then closed around the spring by forming a longitudinal seal either along the side or tops of the spring. The individual pockets within which the springs are contained are then defined by vertical seams which extend for the height of the pocketed springs with each spring separated from the adjacent spring by the vertical seam. The resulting continuous string of pocketed springs is then cut into discrete lengths of pocketed springs which are then assembled and secured together in a side-by-side relationship to create the matrix of strings of pocketed springs illustrated in FIG. 1. The cushion is then completed by adding top cushioning materials as, for example, the pad of resilient foam material 14 and/or fiber 16 after which the complete assembly is encased within upholstered finishing material 20.

In accordance with the practice of this invention, the fabric material 15 within which the springs of the pocketed spring assembly are enclosed is a point bonded, non-woven fabric material as, for example, the point bonded, non-woven fabric material disclosed in U.S. Pat. No. 5,424,115. In accordance with the practice of this invention, this material has a coating of polyethylene or other suitable material sprayed onto or roller coated onto one side of the fabric so as to make it semi-impermeable to air flow as described hereinabove.

Figure 4:
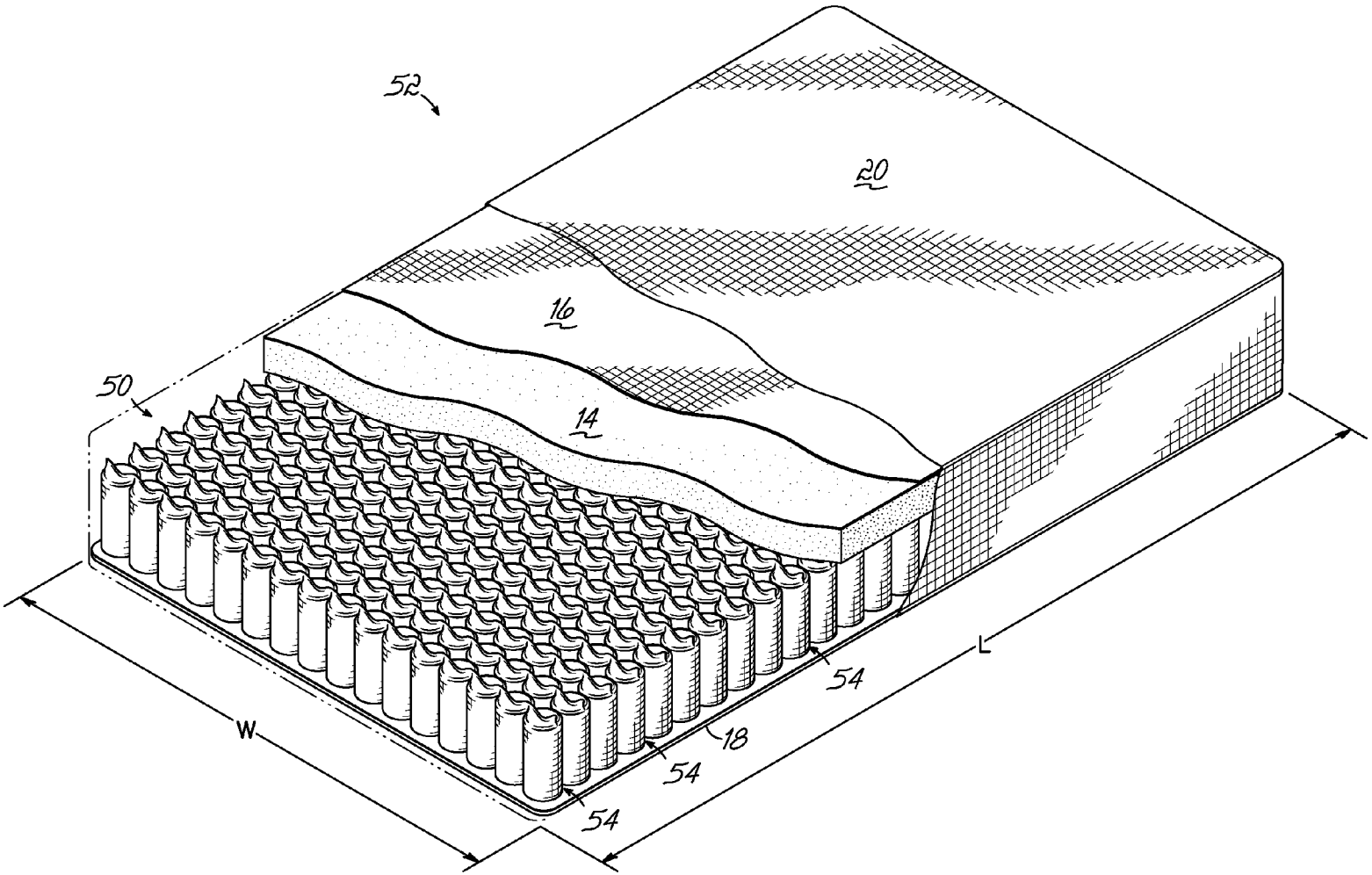
FIG. 4 is a perspective view, partially broken away, of a cushion incorporating an alternative embodiment of pocketed spring core.

FIG. 4 illustrates an alternative embodiment of pocketed spring core 50 incorporated into a single sided mattress 52. Like the single sided mattress 10 described above, this single sided mattress 52 comprises a pocketed spring core, a conventional foam pad 14 on top of the pocketed spring core, a base 18, a fiber pad 16 and an upholstered covering material 20. Pocketed spring core 50 may be incorporated into any bedding or seating product or cushion, including a double sided mattress, and is not intended to be limited to single sided mattresses, like pocketed spring core 10. The product or mattress 52 has a width W extending between side surfaces of the product and a length L extending between end surfaces of the product. It is within the contemplation of this invention that the length and width be identical.

As shown in FIG. 4, pocketed spring core 50 is manufactured by joining together in any known manner multiple strings of springs 54, each string of springs 54 of which extends across the full width of the product 52. These strings of springs 54 are connected in side-by-side relationship as, for example, by gluing the sides of the strings together in an assembly machine, such as the assembly machine disclosed in Mossbeck U.S. Pat. No. 6,159,319, so as to create an assembly or matrix of springs having multiple rows and columns of pocketed springs bound together as by gluing, welding or any other conventional assembly process commonly used to create pocketed spring cores.

Figure 6:
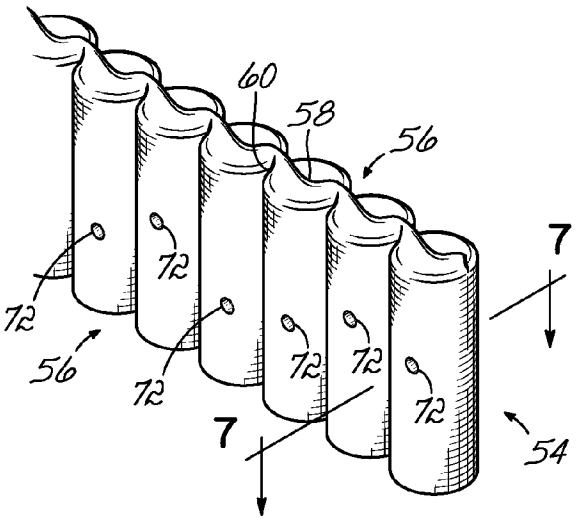
FIG. 6 is an enlarged perspective view of a portion of an alternative string of pocketed coil springs.

With reference now to FIG. 6, there is illustrated a portion of one string 54 of the pocketed spring core 50. This string of springs 54 differs from the strings of coil springs 12A illustrated and described above in that the pockets of fabric 56 secured together by a longitudinal seam 58 and the vertical welded seams 60 between adjacent coil springs 62 in the string of pocketed coil springs 54 are made of multiple-ply material. See FIG. 7.

Figure 7:
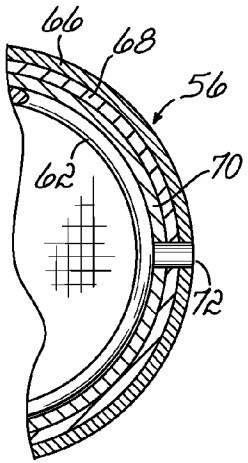
FIG. 7 is a cross-sectional view taken along the line 7-7 of FIG. 6.

As shown in FIG. 7, the pockets of fabric material 64 within which the springs 62 of the pocketed spring assembly 52 are enclosed is a three layered fabric material or web comprising an outer layer 66 of non-woven polypropylene, a middle layer 68 of polyolefin plastic material and an inner layer 70 of non-woven polypropylene, like the outer layer 66. In accordance with the practice of this invention, one or more holes 72 extend through all three fabric layers of each pocket 56 so as to make the pockets 56 of the string of springs 54 semi-impermeable to air flow as described hereinabove. The size of the small hole or holes 72 of each pocket 56 may vary; in one embodiment these holes are 0.125 inches in diameter to create a way for air to escape in a controlled manner when a load is placed on the string of springs 54. See FIG. 6. Although the holes 72 are illustrated in specific locations, they may be located at any desired location with respect to the pockets 56 of the string of springs 54.

Figure 5:
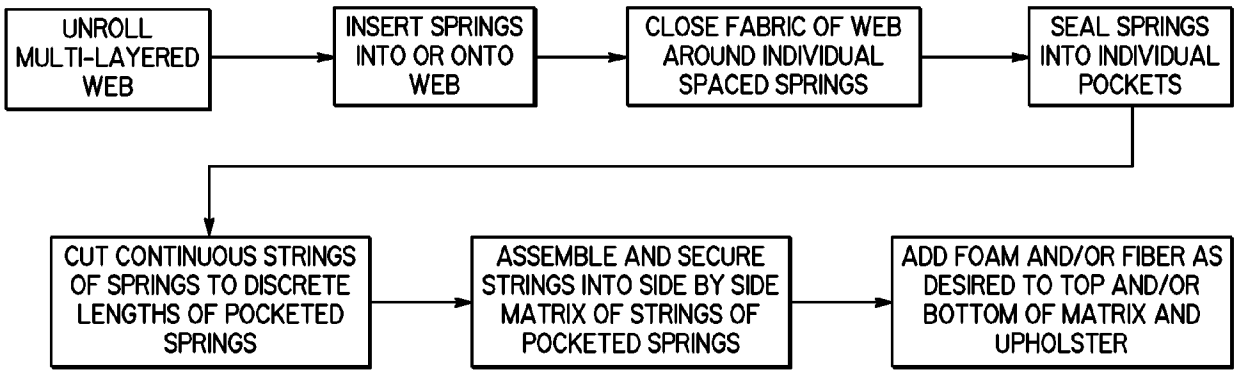
FIG. 5 is a schematic drawing of an alternative process by which cushion spring cores made are manufactured.

With reference now to FIG. 5, there is illustrated the process by which the coil spring assembly of FIG. 4 is manufactured utilizing the machines and processes of the above-identified patents. This process comprises starting with a roll of multi-layered fabric material or a web which is unrolled and has springs either inserted between a fold of the fabric web or placed onto the fabric web. Thereafter, the three layered fabric web is enclosed around the individual spaced springs located either between the folded springs or on the top of the fabric material. The fabric web is then closed around the spring by forming a longitudinal seal either along the side or tops of the spring. The individual pockets within which the springs are contained are then defined by vertical seams which extend for the height of the pocketed springs with each spring separated from the adjacent spring by the vertical seam. The resulting continuous string of pocketed springs is then cut into discrete lengths of pocketed springs which are then assembled and secured together in a side-by-side relationship to create the matrix of strings of pocketed springs illustrated in FIG. 4. The cushion is then completed by adding top cushioning materials as, for example, the pad of resilient foam material 14 and/or fiber 16 after which the complete assembly is encased within upholstered finishing material 20.

While we have described only a single preferred embodiment of this invention, persons skilled in this art will appreciate that other semi-impermeable fabric materials may be utilized in the practice of this invention. Similarly, such persons will appreciate that each pocket may contain any number of coil springs or other type of spring, made of any desired material. Therefore, we do not intend to be limited except by the scope of the following appended claims.

We claim:

1. A bedding or seating cushion core, comprising:

a matrix of interconnected pocketed springs, each spring of which is contained within a pocket, said pocket comprising multiple layers of fabric and being semi-impermeable to air flow through said pocket, opposed plies of fabric being joined by a sinusoidal welded seam;

said matrix creating a cushion core having spaced top and bottom surfaces;

said cushion core being characterized, when a load is placed upon the top surface of the cushion core, by the rate of deflection of the cushion core being retarded by the rate at which air escapes through said semi-impermeable pockets within which the pocketed springs are contained.

2. The cushion core of claim 1 wherein said pocket comprises three layers, a middle layer and outer layers of non-woven polypropylene fabric material.

3. The cushion core of claim 2 wherein said middle layer is made of plastic material.

4. The cushion core of claim 2 wherein said middle layer comprises a polyolefin plastic material.

5. The cushion core of claim 1 wherein said pocket comprises three layers, a middle layer and outer layers of polypropylene fabric material.

6. The cushion core of claim 1 wherein said pocket comprises three layers, a middle layer of polyolefin plastic material and outer layers of polypropylene fabric material.

7. The cushion core of claim 1 wherein said pocket comprises three layers, a middle layer and outer layers of polypropylene fabric material.

8. The cushion core of claim 7 wherein said pocket comprises three layers, a middle layer of polyolefin plastic material and outer layers of polypropylene fabric material.

9. The cushion core of claim 7 wherein said pocket comprises three layers, a middle layer and outer layers of polypropylene fabric material.

10. A bedding or seating cushion core, comprising:

a matrix of interconnected pocketed springs, each spring of which is contained within a pocket of fabric, which pocket of fabric is semi-impermeable to air flow through said fabric due to at least one hole through the pocket of fabric, said pocketed springs being arranged in strings of springs, each of said strings of springs having a longitudinal sinusoidal welded seam;

said matrix creating a cushion core having spaced top and bottom surfaces;

said cushion core being characterized, when a load is placed upon the top surface of the cushion core and then removed, by the rate of return of the cushion core to its original height being retarded by the rate at which air escapes through said semi-impermeable pocket of fabric within which the springs are contained.

11. The cushion core of claim 10 wherein said semi-impermeable pocket of fabric comprises at least one layer of polypropylene non-woven fabric material.

12. The cushion core of claim 11 wherein said semi-impermeable pocket of fabric comprises two outer layers of polypropylene non-woven fabric material and a middle layer of polyolefin plastic film.

13. The cushion core of claim 10 wherein said pocket comprises three layers, a middle layer and outer layers of polypropylene fabric material.

14. The cushion core of claim 13 wherein said middle layer is made of plastic material.

15. A bedding or seating cushion core, comprising:

a matrix of interconnected strings of pocketed springs, each spring of which is contained within a pocket of fabric, which pocket of fabric is semi-impermeable to air flow through said fabric due to at least one hole through multiple layers of fabric including at least one layer of polypropylene non-woven fabric material;

said cushion core being characterized, when a load is placed upon the top surface of the cushion core and then removed, by the rate of return of the cushion core to its original height being retarded by the rate at which air escapes through said semi-impermeable pocket of fabric within which the springs are contained.

16. The cushion core of claim 15 wherein each of said strings of springs has a continuous sinusoidal welded seam.

17. The cushion core of claim 15 wherein said pocket of fabric comprises two outer layers of polypropylene non-woven fabric material and a middle layer of polyolefin plastic film.

18. The cushion core of claim 15 wherein said pocket of fabric comprises three layers, a middle layer and outer layers of polypropylene fabric material.

19. The cushion core of claim 18 wherein said middle layer is made of plastic material.

20. The cushion core of claim 15 wherein said pocket of fabric comprises three layers, a layer of polyolefin plastic material and layers of polypropylene fabric material.

21. The cushion core of claim 15 wherein said pocket of fabric comprises three layers, a middle layer and outer layers of polypropylene fabric material.

22. The cushion core of claim 15 wherein welds between adjacent pockets of fabric are continuous.

* * * * *